US006464300B2

(12) United States Patent
Grove

(10) Patent No.: US 6,464,300 B2
(45) Date of Patent: Oct. 15, 2002

(54) COLLAPSIBLE CHAIR

(76) Inventor: James E. Grove, 4316 Marina City Dr. #423CTN, Marina del Rey, CA (US) 90292

( * ) Notice: Subject to any disclaimer, the term of this patent is extended or adjusted under 35 U.S.C. 154(b) by 0 days.

(21) Appl. No.: 09/785,741

(22) Filed: Feb. 20, 2001

(65) Prior Publication Data

US 2002/0113481 A1 Aug. 22, 2002

(51) Int. Cl.[7] ..... A47C 7/40
(52) U.S. Cl. ..... 297/378.12; 297/378.1
(58) Field of Search ..... 297/378.12, 378.1

(56) References Cited

U.S. PATENT DOCUMENTS

| | | | | | |
|---|---|---|---|---|---|
| 121,362 | A | * | 11/1871 | Hanna | 297/378.12 X |
| 3,784,252 | A | * | 1/1974 | Peterson | 297/378.12 X |
| 4,105,245 | A | * | 8/1978 | Simons et al. | 297/378.12 X |
| 4,775,187 | A | * | 10/1988 | Herr | 297/378.14 |
| 5,018,788 | A | * | 5/1991 | Cedergreen | 297/378.1 |
| 5,658,047 | A | * | 8/1997 | Ratza et al. | 297/378.14 |
| 5,820,220 | A | * | 10/1998 | Wu | 297/378.1 |
| 5,820,221 | A | * | 10/1998 | Greaves et al. | 297/378.14 |
| 6,089,669 | A | * | 7/2000 | Wilcox et al. | 297/378.1 X |

* cited by examiner

*Primary Examiner*—Rodney B. White
(74) *Attorney, Agent, or Firm*—Jack C. Munro

(57) ABSTRACT

An executive office type chair wherein the chair can assume a collapsed position where the back of the chair can be folded to a position against the seat of the chair.

4 Claims, 2 Drawing Sheets

COLLAPSIBLE CHAIR

BACKGROUND OF THE INVENTION

1. Field of the Invention

The field of this invention relates to furniture and more specifically to a chair which can be moved to a collapsed position which is used during shipping from the manufacturer to the retailer and consumer.

2. Description of the Related Art

A typical chair has a seat and a back extending transversely from the seat. This configuration of a chair is not readily adaptable to shipping after being manufactured for the reason that the chair inherently occupies a substantial amount of space. It is common for chairs to be manufactured in overseas manufacturing facilities which means that the chairs are required to be put into boxes and then shipped by shipping containers to the continental United States. The size of the shipping carton for a chair which contains a back attached to a seat in the normal manner is of significant size and therefore greatly limits the number of shipping cartons that can be placed within a shipping container. The result is the cost of shipping chairs that are assembled is substantially greater than when chairs are not assembled.

In the past, to minimize shipping expense of chairs, it has been common to detach the back from the seat. The back can then be placed against the seat with the result that a significantly more compact unit is achieved for purposes of shipping. Once the disassembled chair reaches the retailer, either the retailer or the consumer is required to then assemble the chair. Assembly usually requires several bolt type fasteners to be installed in place and tightened. Many consumers find not only that this assembly of the chair to be annoyance, but it also can be rather time consuming and difficult for certain individuals that have a minimal amount of mechanical skill.

SUMMARY OF THE INVENTION

One of the objectives of the present invention is to construct a chair that is collapsible for purposes of shipping, but upon reaching the selling or consuming destination, the chair can be moved from its collapsed position to its normal usage position without requiring the installation of any fasteners nor use of any tools. Movement of the chair to the usage position is accomplished merely by the act of moving the back of the chair into a transverse position relative to the seat of the chair.

The main embodiment of collapsible chair of the present invention utilizes a seat, which is to be normally located in a substantially horizontal position, which is designed to have the buttocks of the human user to be placed thereon. The seat has an aft edge, and to this aft edge is mounted a lower plate of a hinge bracket. The hinge bracket includes an upper plate with this upper plate being separated from the lower plate by a hinge joint. The upper plate is fixedly secured to a back. This hinge joint permits the back to be moved from a collapsed position located in juxtaposition with the seat to a transverse position which is, in essence, vertical. This transverse position is the usage position.

In another embodiment of this invention, the hinge bracket is shown to be substantially L-shaped.

In another embodiment of this invention, the upper plate of the hinge bracket is defined as being shorter in length than the lower plate.

In another embodiment of this invention, there is formed a seat cavity within the seat and a back cavity within the back. The hinge bracket is to be mounted in both of these cavities.

In another embodiment of this invention, there is provided a cushion which is to be removably mountable within both the seat cavity and the back cavity to cover the hinge bracket and prevent contact of the hinge bracket with the user when the user is occupying the chair.

In another embodiment of this invention, there is provided a means for locking in conjunction with the hinge bracket which is to lock the back of the chair in a fixed position relative to the seat with this position being the usage position.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
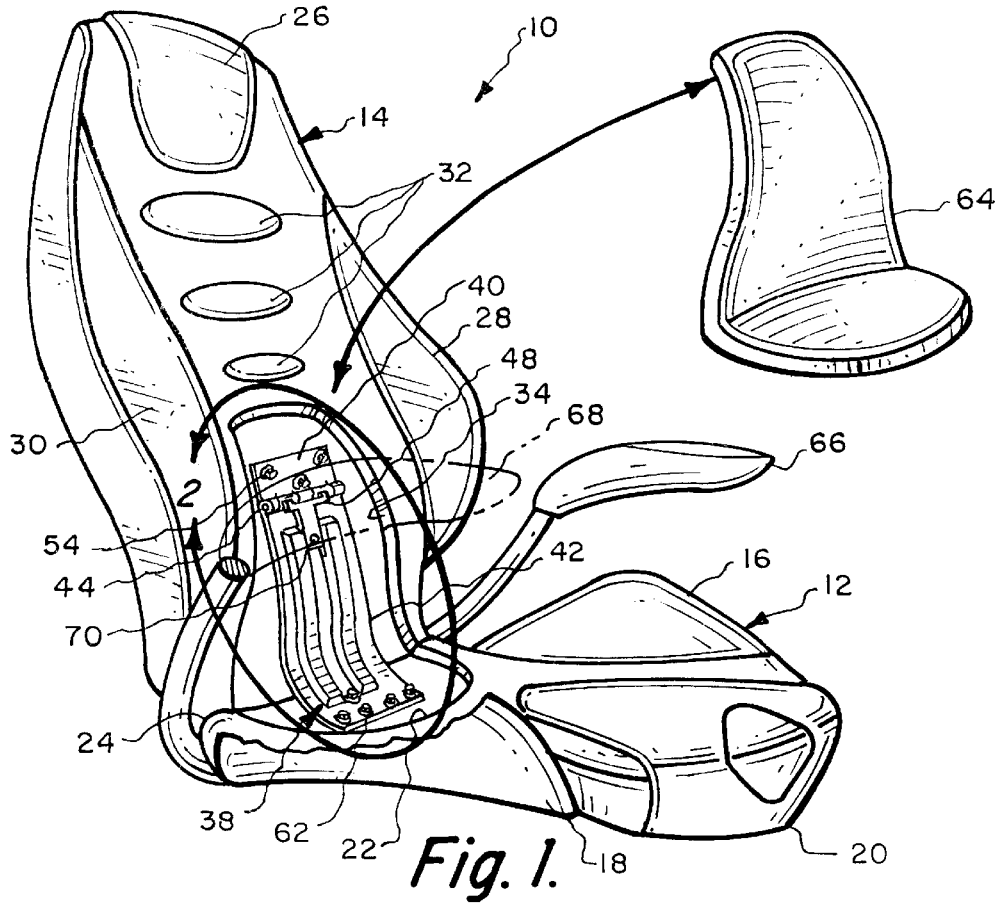
FIG. 1 is an isometric view of the chair constructed in accordance with this invention showing the cushion that is usable to cover the hinge bracket contained within the chair located in a spaced position from its installed position.
Figure 2:
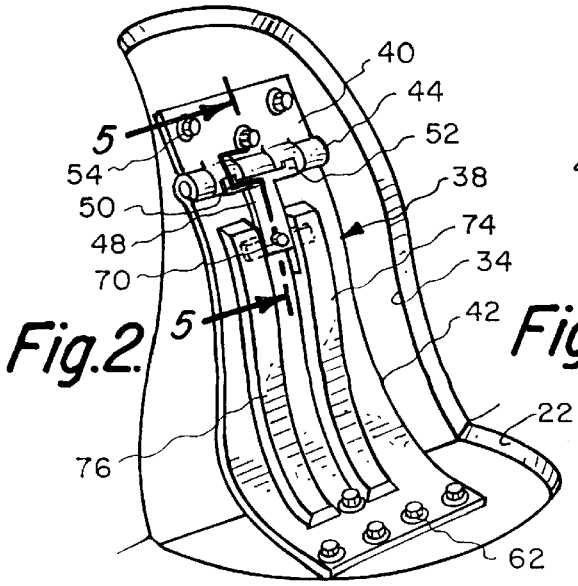
FIG. 2 is an isometric view of the hinge bracket incorporated within the chair of the present invention showing the hinge bracket in the locked position.
Figure 3:
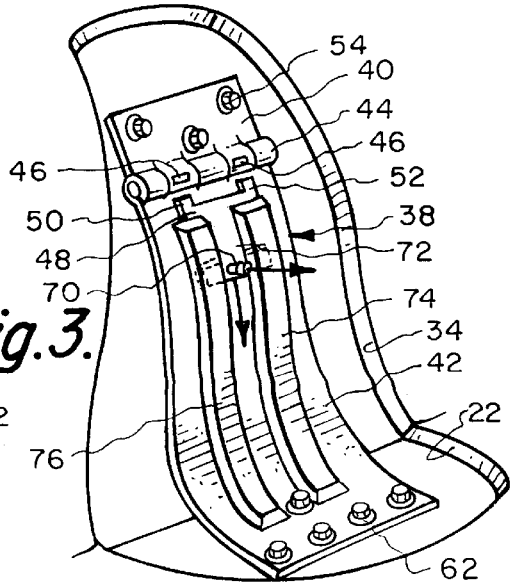
FIG. 3 is a view similar to FIG. 2 but showing the hinge bracket in the unlocked position.

Referring particularly to the drawings, there is shown the collapsible chair 10 of this invention which is composed primarily of a seat 12 and a back 14. The undersurface (not shown) of the seat 12 is to be mounted onto a chair pedestal (which is not shown). The seat 12 has an upper surface which is basically concave. This upper surface extends between first side edges. This upper surface is formed into a left side pad 16 and a right side pad 18. The seat 12 also includes a front pad 20. The pads 16, 18 and 20 are to provide a cushioning surface to provide comfort to the user when sitting on the upper surface of the seat 12. The upper surface of the seat 12 also includes a seat cavity 22. The seat cavity 22 is located adjacent to and connects with the aft end 24 of the seat 12.

The back 14 has a front surface which includes a head pad 26, a left side lateral restraint pad 28 and a right side lateral restraint pad 30. The front surface extends between a pair of second side edges. The front surface of the back 14 also is to include a series of elliptical shaped cushioning pads 32. The front surface of the back 14 also includes a back cavity 34. The back cavity 34 connects with the lower edge 36 of the back 14.

An L-shaped hinge bracket 38 has an upper plate 40 and a lower plate 42. The upper plate 40 is connected to the lower plate 42 by means of a hinge joint 44. The hinge joint 44 includes a pair of holes 46. Connectable with the holes 46 is a bifurcated member 48. The bifurcated member 48 has a pair of outwardly protruding pins 50 and 52 with each pin 50 and 52 to connect with a separate hole 46. When the pins 50 and 52 are connected with the holes 46, the upper plate 40 is fixed into position relative to the lower plate 42. The upper plate 40 is to be fixedly secured by bolt fasteners 54 to main support member 56 which is embedded within the back 14. Surrounding the main support member 56 is cushioning material 58. Covering the cushioning material 58 is a vinyl or leather covering 60.

The lower plate 42 is fixedly secured by bolts 62 to the seat 12. It is to be noted that the hinge bracket 38 is of a basic L-shape with the lower plate 42 being substantially longer in length than the upper plate 40. The reason for this is so that the back 14 will fold down in the correct position relative to the seat 12 when it is in the collapsed position. The extra length of the lower plate 42 is required due to the thickness of the padding on the seat 12. The lower plate 42 has a smoothly contoured arcuate configuration. The hinge bracket 38 is totally confined within the seat cavity 22 and the back cavity 34. When the chair 10 is in the usage position shown in FIG. 1, the hinge bracket 38 is covered by cushion 64 with this cushion 64 being snugly located within the seat cavity 22 and the back cavity 34 covering up the bracket 38 so that at no time will the bracket 38 come into contact with the body of the user.

Figure 4:
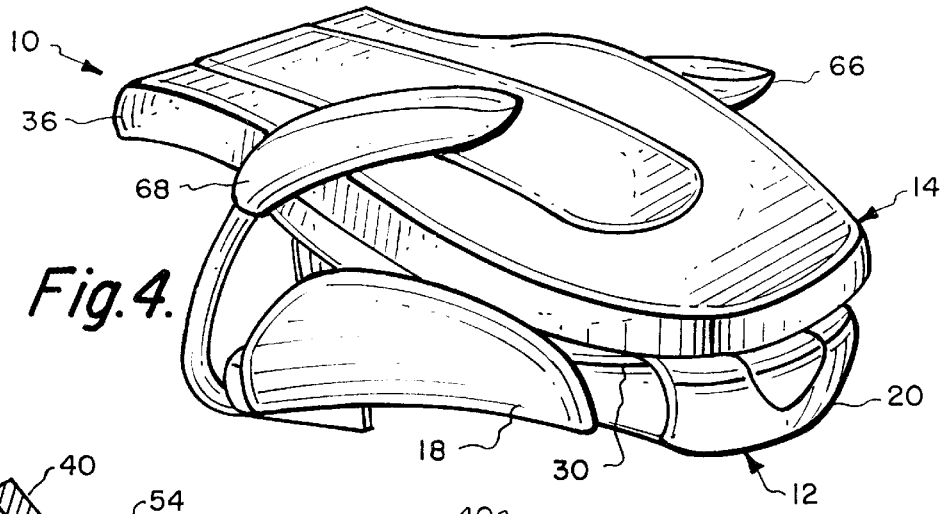
FIG. 4 is an isometric view of the chair of this invention showing the back of the chair in its collapsed position against the seat of the chair.

Because of the hinge joint 44, the back 14 can be pivoted to be located against the seat 12 and located between the left armrest 66 and the right armrest 68, which is shown in FIG. 4 of the drawings. This is the collapsed position facilitating shipping of the chair 10 of this invention. It is to be noted that during shipping the chair 10 is not mounted on its pedestal (which is not shown).

After the chair 10 has been shipped to its desired location and it is desired to place the chair in a usage position, it is only necessary for the user to cause the back 14 to physically pivot relative to the seat 12 until the back 14 assumes a right angled configuration relative to the seat 12. The user then removes cushion 64. When in this position, the user is to grasp fastener 70 and physically slide slidable plate 72 in an upward direction between strengthening ribs 74 and 76 which are formed within the lower plate 42. The sliding of the slidable plate 72 is to be until pins 50 and 52 engage with the spaced apart holes 56. At this time, the fastener 70 can then be moved into hole 78 which is formed in the lower plate 42 which locks the slidable plate to lower plate 42. The fastener 70 has mounted at its outer end a pin 80 that protrudes therefrom. The hole 78 includes a pair of side holes 82 which are diametrically located relative to the hole 78. The pin 80 is able to slip through these side holes 82 and then by merely rotating of the fastener 70 ninety degrees, the fastener 70 will then be locked to the lower plate 42. This locked position now fixes in position the back 14 relative to the seat 12 and the back 14 is not capable of being moved to the collapsed position.

The slidable plate 72 includes side flanges 84 and 86. Side flange 84 is conducted through slot 88 formed within the strengthening rib 74. Side flange 86 is conducted through slot 90 formed within the strengthening rib 76. The length of the slots 88 and 90 are identical and is what determines the length of travel of the slidable plate 72. Because of the side flanges 84 and 86 which ride in their respective slots 88 and 90, outward movement from lower plate 42 of the slidable plate 72 is prevented.

Figure 5:
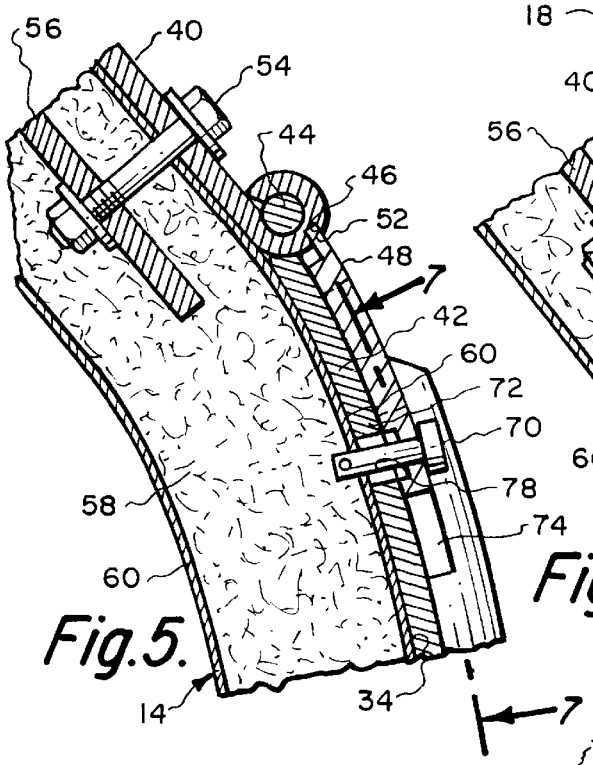
FIG. 5 is a cross-sectional view taken along line 5—5 of FIG. 2 showing the lock that is incorporated in conjunction with the hinge bracket in the locked position.
Figure 6:
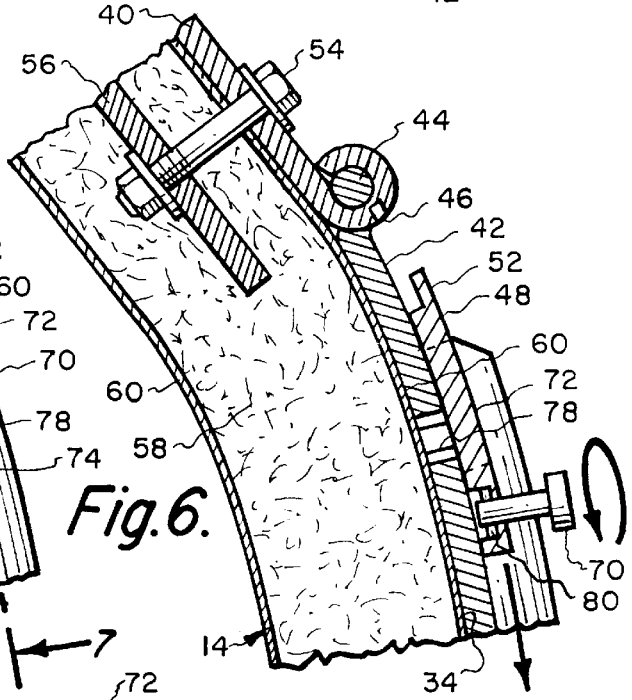
FIG. 6 is a cross-sectional view similar to FIG. 5 but showing the lock in the unlocked position.
Figure 7:
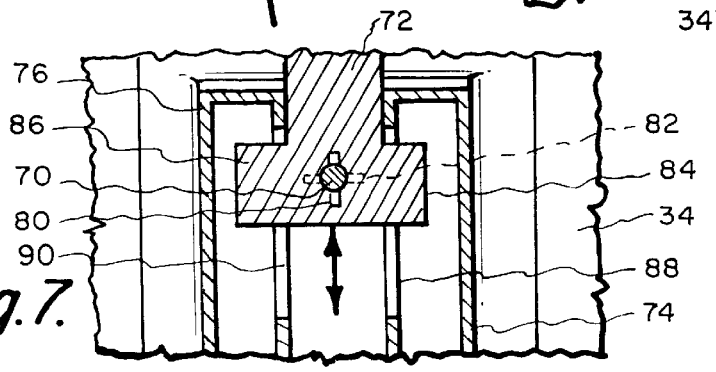
FIG. 7 is a cross-sectional view taken along 7—7 of FIG. 5.

It is to be understood that with the chair 10 in the locked position, shown in FIG. 5, the user can grasp the fastener 70, rotate it ninety degrees and move the pin 80 through the side holes 82. The pin 80 will prevent complete retraction of the fastener 70 from the slidable plate 72. At this time, the slidable plate 72 is capable of being moved withdrawing the pins 50 and 52 from the holes 46 thereby unlocking the hinge joint 44 and permitting the back 14 to be pivoted into the collapsed position shown in FIG. 4.

The present invention may be embodied in other specific forms without departing from the essential attributes thereof. Reference should be made to the appending claims rather than the foregoing specification as indicating the scope of the invention.

What is claimed is:

1. A collapsible chair comprising:

a seat which is adapted to support the buttocks of a human user on an upper surface, said seat having an aft edge, said seat having spaced apart first side edges with said upper surface being located between said first side edges;

a back locatable directly adjacent said seat, said back to be connected to said seat at said aft edge, said back having spaced apart second side edges with a front surface located between said second side edges; and a hinge bracket having an upper plate and a lower plate connected together by a hinge joint, said upper plate being fixed to said back directly adjacent said front surface in between said second side edges, said lower plate being fixed to said seat directly adjacent said upper surface in between said first side edges, said back being pivotable about said hinge joint from a usage position located transverse to said seat to a stowage position located in juxtaposition with said seat, thereby when said seat is in said stowage position said chair occupies a substantially decreased space facilitating shipping.

2. A collapsible chair comprising:

a seat which is adapted to support the buttocks of a human user, said seat having an aft edge;

a back locatable directly adjacent said seat, said back to be connected to said seat at said aft edge;

a hinge bracket having an upper plate and a lower plate connected together by a hinge joint, said upper plate being fixed to said back, said lower plate being fixed to said seat, said back being pivotable about said hinge joint from a usage position located transverse to said seat to a stowage position located in juxtaposition with said seat, thereby when said seat is in said stowage position said chair occupies a substantially decreased space facilitating shipping; and said seat having a seat cavity, said back having a back cavity, said upper plate being mounted within said back cavity, said lower plate being mounted within said seat cavity.

3. The collapsible chair as defined in claim 2 wherein:

an L-shaped cushion being mountable within said seat cavity and said back cavity, said L-shaped cushion functioning to cover said hinge bracket when said chair is being used, said cushion being disconnectable from said seat cavity and said back cavity causing exposing of said hinge bracket.

4. The collapsible chair as defined in claim 1 wherein:

means for locking mounted on said hinge bracket, said means for locking being movable between a locking position and an unlocking position, with said means for locking being located in said locking position said back is fixed in said usage position, with said means for locking in said unlocking position said back is to be movable to said stowage position.

* * * * *